US006260313B1

(12) United States Patent
Stegmeier

(10) Patent No.: US 6,260,313 B1
(45) Date of Patent: Jul. 17, 2001

(54) CANTILEVERED COPING OVER THE TOP STEP OF AN IN-GROUND LINER TYPE SWIMMING POOL

(76) Inventor: William J. Stegmeier, 1115 Harris Rd., Arlington, TX (US) 76001

( * ) Notice: Subject to any disclaimer, the term of this patent is extended or adjusted under 35 U.S.C. 154(b) by 0 days.

(21) Appl. No.: 09/450,862

(22) Filed: Nov. 29, 1999

(51) Int. Cl.[7] ..... E04H 4/02

(52) U.S. Cl. ..... 52/169.7; 52/169.1; 52/189; 52/741.41; 52/742.14; 4/488; 4/496

(58) Field of Search ..... 52/21, 107, 169.7, 52/169.6, 169.1, 189, 190, 741.41, 742.14; 4/488, 496

(56) References Cited

U.S. PATENT DOCUMENTS 3,526,070 * 9/1970 Deason ..... 52/169.7
3,708,930 * 1/1973 Stegmeier ..... 52/169.7 X
3,967,422 * 7/1976 Stegmeier ..... 52/169.7
3,968,191 * 7/1976 Stegmeier ..... 52/169.7 X
4,589,237 * 5/1986 Dahowski ..... 52/169.7
4,706,308 * 11/1987 Palmere ..... 4/496
4,967,424 * 11/1990 Stegmeier ..... 4/496
5,916,099 * 7/1999 Hall ..... 52/169.7

OTHER PUBLICATIONS

Homecrest Casual and Outdoor Furniture "Pool & Spa News" Oct. 20, 1999.
Photo—Unnamed & Undated.

* cited by examiner

*Primary Examiner*—Carl D. Friedman
*Assistant Examiner*—Brian E. Glessner
(74) *Attorney, Agent, or Firm*—Daniel Rubin

(57) ABSTRACT

Method, apparatus and product providing a cantilevered coping about prefabricated stairs of an in-ground liner type swimming pool. Disclosed is a polystyrene form board of desired profile face to effect a complementary fit onto a top of the stairs, fastener means including a saddle bracket for securing the form board onto the stairs and a release structure to enable removing the form board after the poured aggregate coping has cured.

16 Claims, 6 Drawing Sheets

CANTILEVERED COPING OVER THE TOP STEP OF AN IN-GROUND LINER TYPE SWIMMING POOL

FIELD OF THE INVENTION

The field of art to which the invention relates comprises method and apparatus for forming cantilevered coping about the top step of an in-ground liner type swimming pool and the product thereof.

BACK OF THE INVENTION

In-ground swimming pools are typically constructed of either concrete walls or ground walls with a replaceable liner for containment of the water. The liner of the latter is supported by a track secured to a panel above contemplated water level and draped inward of the cavity or bowl in which the water is to be contained. The stair steps of an in-ground liner pool are typically of molded fibreglass and of a design commonly marketed commercially by various manufacturers. Some of the stair walls are typically sloped and include both pre-formed offsets near their upper edges and a radius along their top edge.

Cantilevered poured aggregate coping is commonly provided above a pool interior whether of concrete or the liner type. It has long been an industry desire with the liner type pool to be able to form poured aggregate cantilevered coping about the top of the stair consistent with other sections of the pool. Poured coping is considerably less expensive than precast coping that can be commercially purchased but requires use of a pre-configured form board to receive and shape the concrete when poured. However, wall slopes, offsets, etc. normally contained in prefabricated fibreglass stairs render it difficult, if not impossible, to provide and suitably support a form board in proper orientation. As a result, existing form boards for this purpose have, for example, produced an uneven and distracting reveal where the concrete adjoins the lower edge of the radius.

DESCRIPTION OF THE PRIOR ART

Cantilevered coping of poured aggregate is commonly provided for in-ground liner type swimming pools everywhere but about the stairs. However, all polystyrene forms currently available for that purpose are required to be side mounted using double face tape to attach them to the surface of the adjacent wall panel. Such wall panels are characterized as having sharp 90 degree corners at their upper edge and are also set plumb. A polystyrene form board for that purpose is disclosed, for example in U.S. Pat. No. 4,967,424.

Consequently, forming cantilevered coping of poured aggregate over prefabricated fiberglass stairs of a liner type pool has encounted extreme difficultly in its formation of the cantilevered coping because of surface irregularities in the stair configuration. This has rendered use of the conventional polystyrene form board extremely difficult in that the board cannot be properly set and secured at the desired orientation and yet be able to withstand the force of the aggregate when poured.

As a result of the foregoing, it has become common to use an erect vertical profile on the coping face in these circumstances and forego a cantilevered formation over the stairs. This then produces a coping format at the stair area that differs in construction and appearance from other sections of the pool.

Despite recognition of the foregoing, a ready solution therefor had not heretofore been known.

OBJECTS OF THE INVENTION

It is therefore an object of the invention to provide novel method and apparatus for effecting poured aggregate coping over prefabricated stairs of an in-ground liner type swimming pool.

It is further object of the invention to effect the previous object in a reliable and economical manner.

It is still further object of the invention to construct poured aggregate coping over the stairs as in the previous objects aesthetically similar to the poured coping contained elsewhere about the pool.

SUMMARY OF THE INVENTION

This invention relates to forming poured aggregate coping over prefabricated stair steps of an in-ground liner type swimming pool. More specifically, the invention relates to method and apparatus able to accommodate the poured aggregate in forming the cantilevered coping over the stair steps and the coping formed thereby.

For achieving the foregoing, there is provided a polystyrene form board configured in a first profile to receive and shape the received aggregate and in a second profile below the first profile to complement the stair configuration thereat. The form board is secured in place by a plurality of spaced apart L-shaped saddle brackets extending through grooves in the underside of the form board and attached thereto via double faced tape or cement. The bracket in the vicinity of its distal end is slotted to receive a self tapping screw that secures the bracket to the top of the step. In addition, a frangible wire extends through the form board from a free end at the back to an anchor at the front edge of the step. The bracket, in combination with the wire, afford board retention in response to an applied thrust force of the aggregate when poured.

For release of the bracket and wire after the aggregate has cured, nylon string is supported on each bracket to enable the bracket to be saw cut from the board and the bracket stripped from under the self tapping screw. With the rear of the connecting wire broken away, and the bracket removed, the form board is released and can be readily removed without disturbing the finished concrete.

As a result of the foregoing, cantilevered coping can be readily formed over the stair steps having an appearance corresponding to the cantilevered coping located elsewhere about the pool.

The above noted features and advantages of the invention as well as other superior aspects thereof will be further appreciated by those skilled in the art upon reading the detailed description which follows in conjunction with the drawings.

BRIEF DESCRIPTION OF THE DRAWINGS

FIG. 1 A is a sectional view as seen substantially along the lines 1A—1A of FIG. 1;

DESCRIPTION OF THE PREFERRED EMBODIMENT

Figure 1:
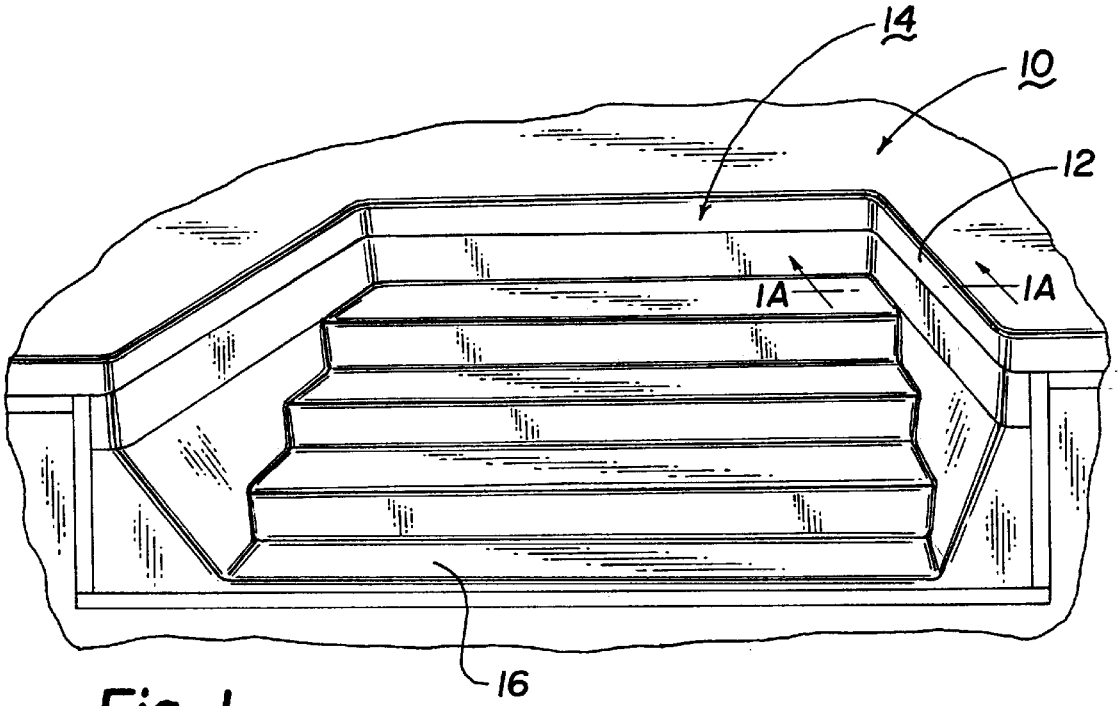
Fig. 1 PRIOR ART
FIG. 1 is a perspective front view of prior art decking poured about the stairs steps of an in-ground liner type swimming pool.

In the description which follows, like parts are marked throughout the specification and drawings with the same reference numerals respectively. The drawing figures are not necessarily to scale and in a certain views, proportions may have been exaggerated for purposes of clarity.

Figure 1A:
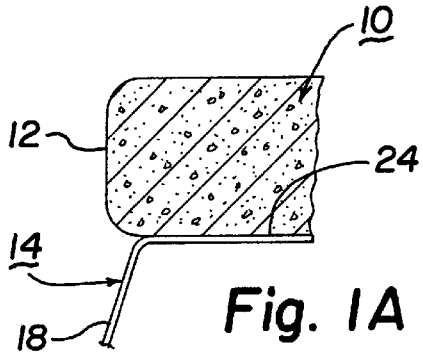
Fig. 1A PRIOR ART
Figure 2:
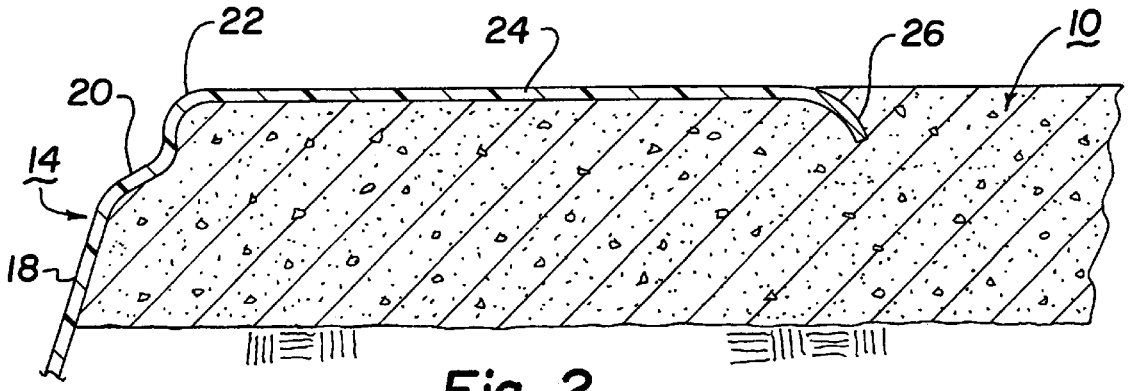
Fig. 2 PRIOR ART
FIG. 2 is a sectional view of another prior art embodiment.

Referring now to FIGS. 1, 1(A) and 2, of the drawings there is illustrated prior art constructions of poured aggregate decking about prefabricated stairs for an in-ground liner type swimming pool. As seen in FIGS. 1 and 1(A), decking 10 extends to radial face 12 just beyond stairs 14 having steps 16. In the prior art of FIG. 2, there is shown a stair 14 having a downwardly sloping wall 18 merging with offset recess 20 that via radius 22 join top surface 24 that terminates at a distal inwardly curved end 26. Because of the stair profile, aggregate 10 has been placed within and behind the underside of stair 14.

Figure 3:
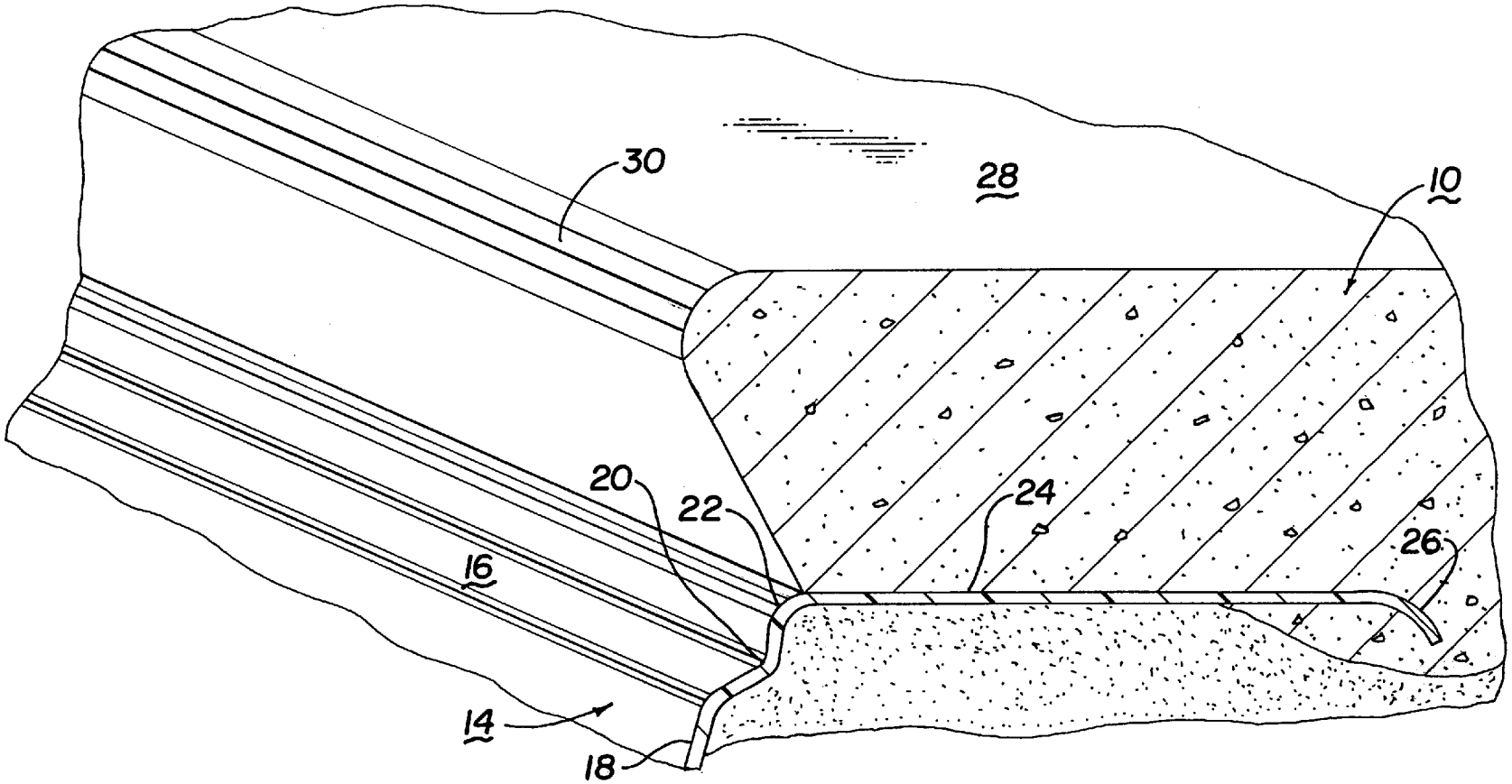
FIG. 3 is an isometric side view of the cantilevered coping formed in accordance with the invention hereof.
Figure 4:
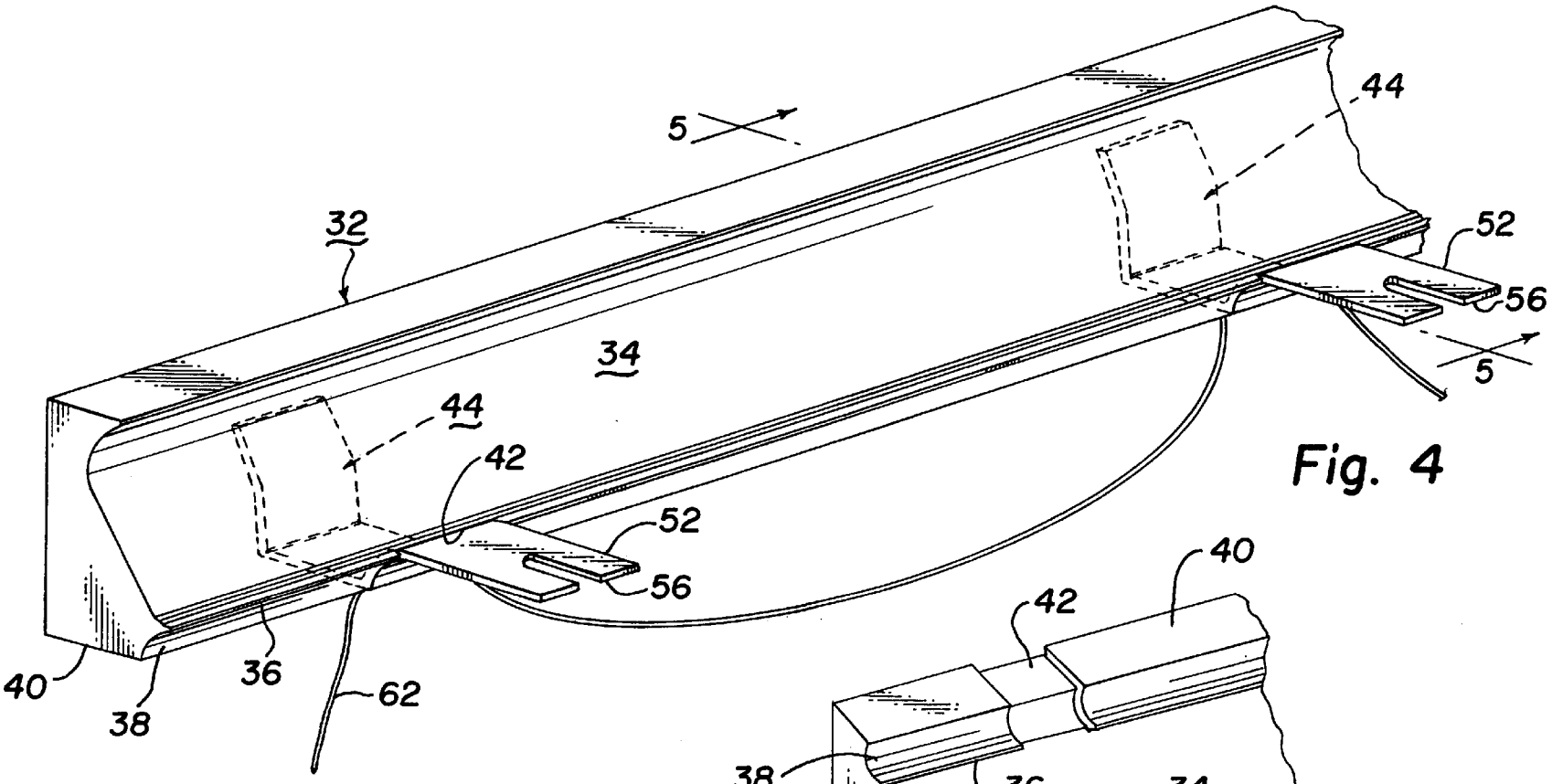
FIG. 4 is an isometric front view of a form board for forming the poured coping of FIG. 3.
Figure 4A:
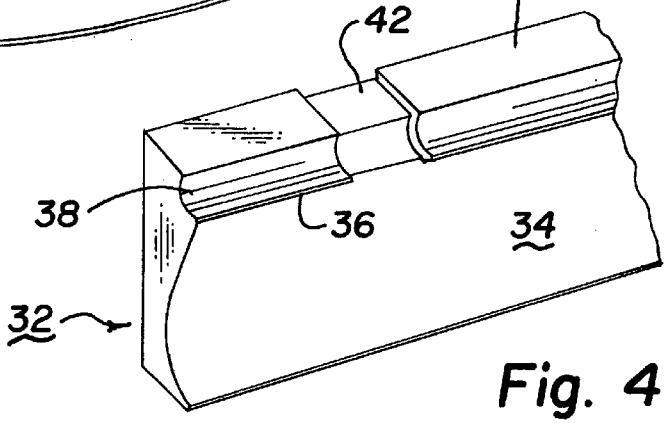
FIG. 4(A) is an inverted isometric view of the form board of FIG. 4.

Referring to FIG. 3, there is illustrated a poured coping 28 formed on the previous stair 14 of FIG. 2 in which the coping is supported over rather than under the top surface 24 of the stairs to cantilevered edge 30. For effecting the coping formation of FIG. 3, there is shown in FIGS. 4 and 4(A) the elongated polystyrene form board 32 having a longitudinal extending frontal vertical recess 34 of profile corresponding to the configuration of edge 30. The bottom of the recess 34 terminates at edge 36 below which there is provided a longitudinal concave recess 38 that essentially complements the configured shape of stair radius 22 (FIG. 2). For mounting and securing form board 32 in place there is formed in the underside 40 of the form board at predetermined spacings of about 10–12 inches rectangular grooves 42 (FIG. 4(A)) in which to receive and secure saddle brackets 44.

Figure 5:
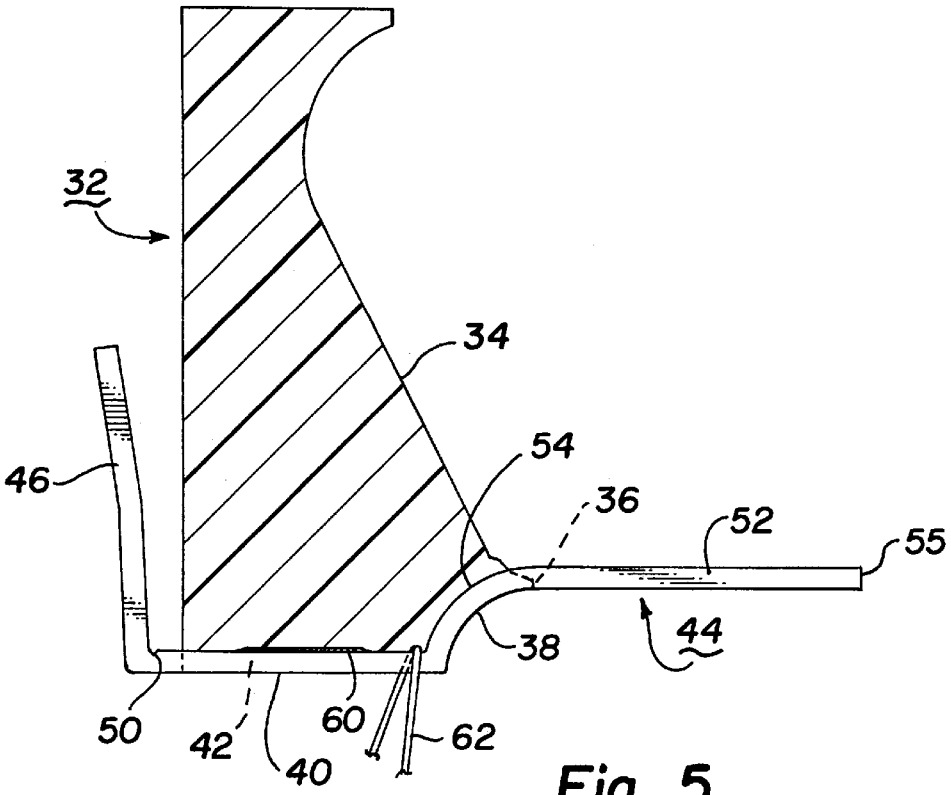
FIG. 5 is a sectional elevation as seen substantially along the lines 5—5 of FIG. 4.
Figure 6:
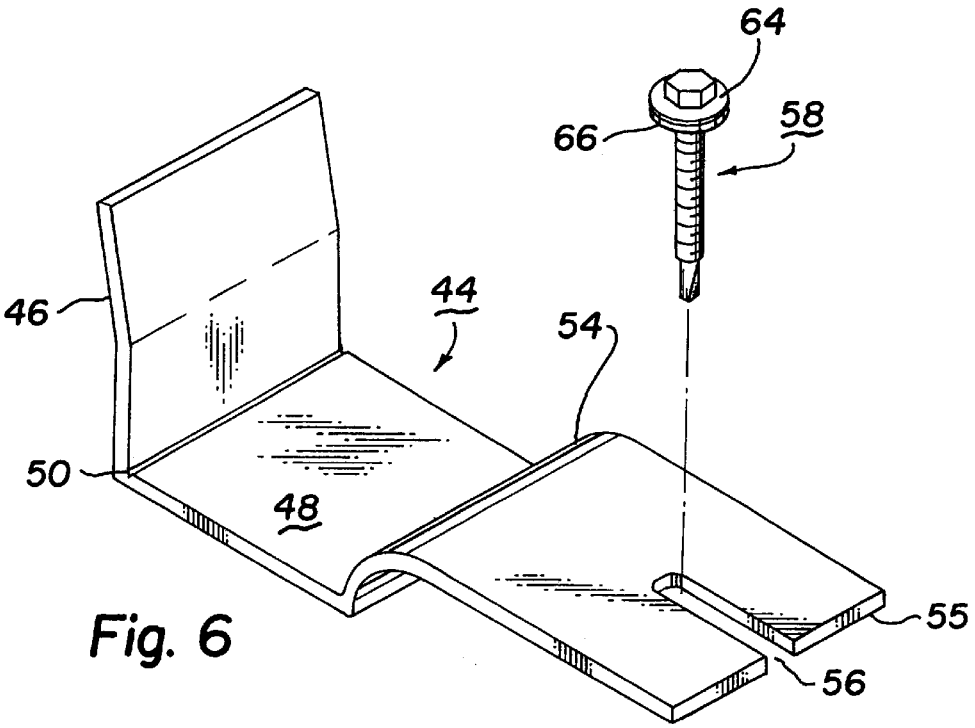
FIG. 6 is an isometric view of the saddle bracket utilized with the form board of FIG. 4.
Figure 7:
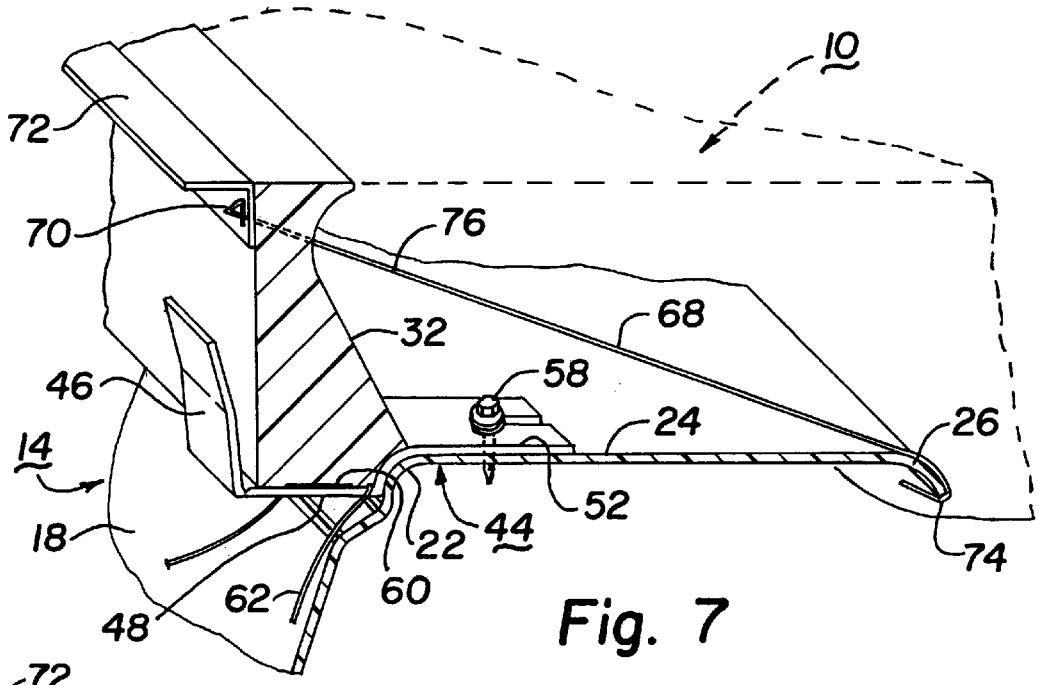
FIG. 7 is an isometric view of the form board with support to form the aggregate coping of FIG. 3.

The saddle brackets can be best seen in FIGS. 5, 6, and 7, and are of a more or less L-shape configuration of plastic composition. Each bracket includes a rear or upright wall 46 integrally joined to bottom wall 48 at which there is provided a break away cut 50 forming a joint for reasons as will be understood. The bottom wall 48 is joined with horizontal front wall 52 via radius 54 conforming with radius 38 of the form board. Beyond the radius 54, front wall 52 extends to a distal end 55 containing an elongated open end slot 56.

Each bracket is received and secured in groove 42 with double faced tape or adhesive cement 60 applied to the top surface of bottom wall 48. Self tapping screw 58 inserted through slot 56 is adapted to secure the front wall 52 to the top surface 24 of the stairs. For reasons as will be understood, screw 58 includes a metal washer 64 supported at its underside by a smooth rubber washer 66. Also for reasons as will be understood, bracket 44 includes not only the break away 50 but supports a thin Nylon string 62 at the intersection of wall 48 and radius 54.

Also securing the provided form board in place is an elongated thin gauge but strong wire 68 that extends from a knot 70 behind angle bracket 72 to through the form board 32 to distal end 74 hooked to the edge 26 of stair 14. Characterizing the wire 68 is frangible joint 76 enabling the wire to fracture in response to an applied twisting motion and be partially withdrawn as will be understood.

Figure 8:
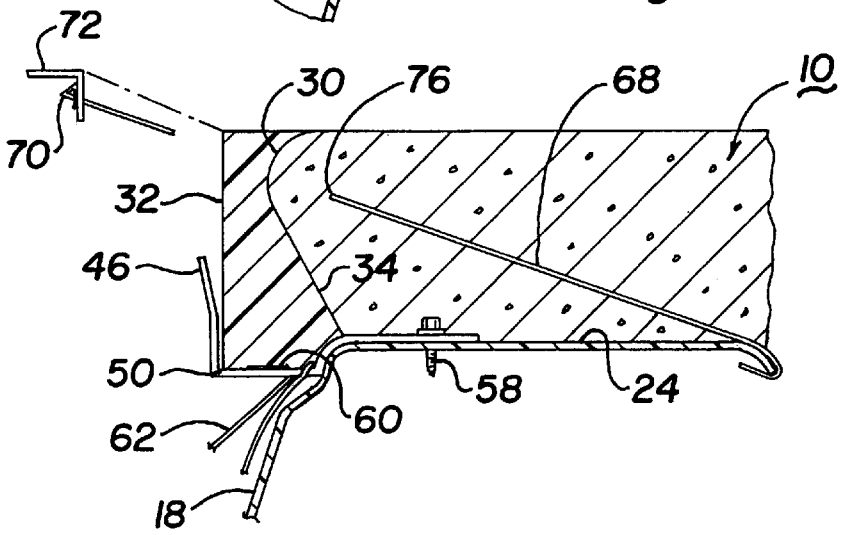
FIG. 8 is a sectional view illustrating the first step of releasing the form board from the poured aggregate coping.
Figure 9:
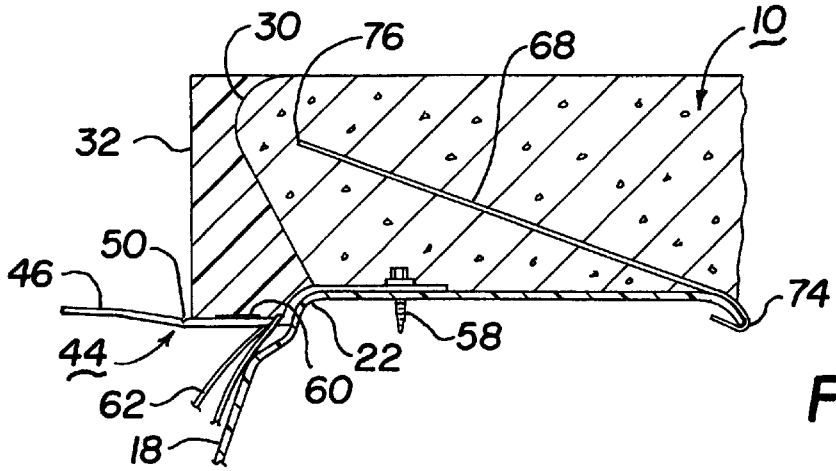
FIG. 9 is a sectional view illustrating the second step in releasing the form board from the poured aggregate coping.
Figure 10:
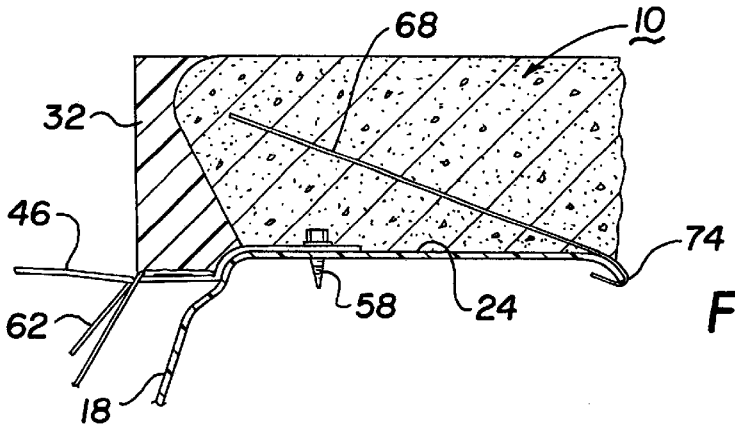
FIG. 10 is a sectional view illustrating the third step in releasing the form board from the poured aggregate coping.
Figure 11:
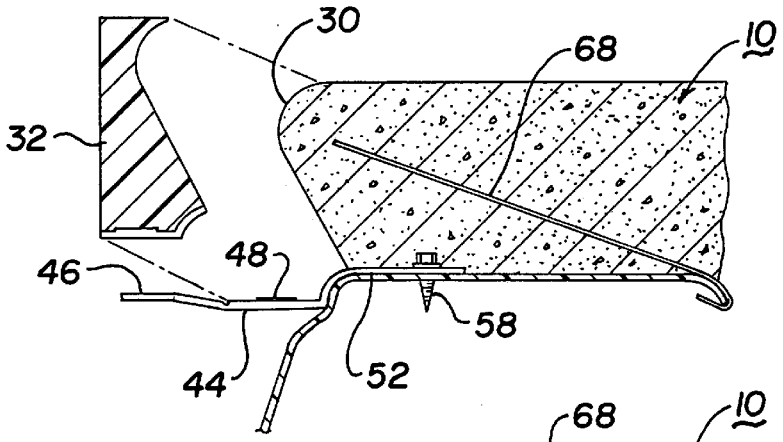
FIG. 11 is a sectional view illustrating removal of the form board from the cured aggregate.
Figure 12:
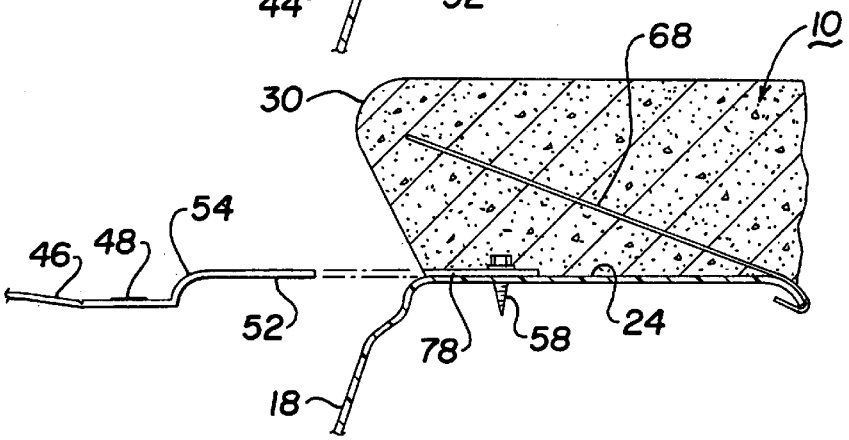
FIG. 12 is a sectional view illustrating the fourth step of removing the saddle bracket from the form board.
Figure 13:
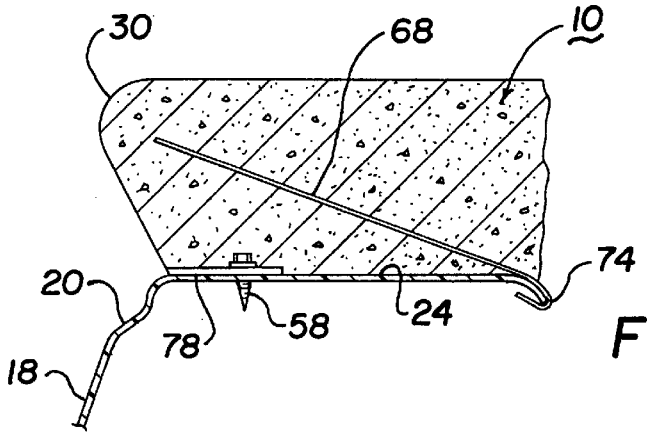
FIG. 13 is a sectional view illustrating the completed cantilevered coping of FIG. 3.

Form board 32 is secured in the manner illustrated in FIG. 7 for the decking 10 to be poured in a conventional manner against profile face 34 so as to result in a cantilevered edge 30 overhanging the top portion of the stairs 14. After the aggregate of decking 10 (in phantom) is completely cured, the form board is removed by first fracturing wire 68 at joint 76 by twisting the exposed portion of wire 68 at knot 70. This end behind angle bracket 72 can then be removed. Back wall 46 of saddle bracket 44 is then manually bent downwardly about hinge connection 50 from the position shown in FIG. 8, to the position shown in FIG. 9. Thereafter string 62 is sawed while being rearwardly withdrawn until displaced back and forth from the position of FIG. 9 to the relation of FIG. 10. In doing so, the form board is cut above the adhesive 60 (or double sided tape) so as to separate the form board from the saddle bracket 44 enabling form board 32 to be withdrawn as shown in FIG. 11. With the board removed, bracket 44 can be readily withdrawn from beneath the rubber gasket of screw 58 in the manner shown in FIG. 12. What remains thereat is a finished cantilevered coping as shown in FIG. 13. Screw 58 and the buried portion of wire 68 remain in the finished coping and remaining slots 78 can conveniently be patched by a workman on site.

By the above description there has been disclosed novel method and apparatus along with a cantilevered coping about the irregular surface of a prefabricated stair of an in-ground liner type swimming pool. The foregoing enables the cantilevered coping to extend in a uniform formation about the entire pool without interruption in and about the stairs. Yet the method and apparatus for achieving these results are relatively simple with a concept for readily resolving a long felt need in the industry and without any excessive cost changes being encountered.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed is:

1. A method of forming a cantilevered coping about vertically sloping or offset riser walls of a pefabricated stairs of an in-ground liner type swimming pool, comprising steps of:

a). providing a form board for a positioned placement against said prefabricated stair on which the coping is to be formed; said form board having a first inner surface profile with the configuration of coping face to be formed and a second inner surface profile below said first inner surface profile with a configuration face to complement the profile of stair surface thereat against which it is to be positioned;

b). positioning said form board in a plumb orientation against the vertically sloping or offset riser walls of said stair;

c). securing said form board in said plumb orientation to receive and withstand the thrust of poured aggregate of which the coping is to be formed;

d). pouring said aggregate; and e). after curing of said poured aggregate, removing said form board from said coping.

2. A method in accordance with claim 1 in which the step of securing said form board includes the step of providing a plurality of saddle brackets at predetermined interval spacings along said form board to secure the underside of said form board to a top surface of the stairs thereat.

3. A method in accordance with claim 2 in which said form board is of a polystyrene composition.

4. A method in accordance with claim 2 in which said form board includes grooves defined on its undersurface, each saddle bracket extends through one of said grooves and there is provided adhesive means applied to said brackets or grooves to secure said brackets to the underside of said form board and there is provided fastener means for securing each saddle bracket to the stairs at a location beyond said form board.

5. A method in accordance with claim 4 in which there is provided an elongated wire which extends free from an end behind said form board through said form board to a distal end anchored to the stairs thereat.

6. A method in accordance with claim 5 in which the step of removing said form board includes the steps of removing said saddle bracket and at least the free end of said wire.

7. A method in accordance with claim 5 in which the step of removing said saddle bracket includes the step of cutting the saddle bracket away from the underside of said form board.

8. A method in accordance with claim 7 in which the step of cutting said saddle bracket includes providing a wire-like string on said bracket intervening between the underside of said form board and said bracket and utilizing the string to draw through the form board above the adhesive means thereat.

9. A method in accordance with claim 7 in which the step of removing at least the free end of said wire includes the step of twisting said wire at said free end to effect a fracture separation of said wire within the aggregate to release said free end and withdrawing the released free end of said wire from said form board.

10. Apparatus for forming a poured aggregate cantilevered horizontal coping about vertically sloping or offset riser walls of a prefabricated stair of an in-ground liner type swimming pool comprising;

a). a form board for positional placement against said prefabricated stair at which said horizontal coping is to be formed, said form board having a first inner face profile with a configuration of coping to be formed and a second inner face profile below said first inner face profile configurated to complement the profile of stair surface at which the form board is to be placed, and b). a removable securement means to secure said form board in a plumb orientation at said placement position.

11. An apparatus in accordance with claim 10 in which said form board is comprised of polystyrene composition.

12. An apparatus in accordance with claim 10 in which said securement means includes fasteners for securing said form board to a stair surface about which said coping is to be formed.

13. An apparatus in accordance with claim 12 in which said securement means also includes a saddle bracket secured to the said form board and adapted to receive a fastener effective to secure said form board to the stair thereat.

14. An apparatus in accordance with claim 13 including release structure to enable removing said form board and bracket from said placed position after the poured aggregate of said coping has cured.

15. An apparatus in accordance to claim 14 in which said saddle bracket includes a slot extending horizontally to a distal end and through which to receive said fastener, said received fastener comprises a screw for extending through said slot to secure said bracket into a tightened relation against the stair surface and there is included a resilient washer compressed between the screw head and the bracket surface thereat.

16. An apparatus in accordance to claim 15 which said resilient washer is comprised of a rubber composition and enables said bracket to be slidably released from said placed position.

* * * * *